US008769901B2

(12) United States Patent
Todd et al.

(10) Patent No.: US 8,769,901 B2
(45) Date of Patent: Jul. 8, 2014

(54) CLADDING SYSTEM FOR BUILDING LAMINATES

(75) Inventors: Gavin Todd, Cincinnati, OH (US); Joe Ramuta, Wausau, WI (US)

(73) Assignee: The Diller Corporation, Cincinnati, OH (US)

( * ) Notice: Subject to any disclaimer, the term of this patent is extended or adjusted under 35 U.S.C. 154(b) by 0 days.

(21) Appl. No.: 13/700,516

(22) PCT Filed: May 25, 2011

(86) PCT No.: PCT/US2011/037871

§ 371 (c)(1),
(2), (4) Date: Feb. 6, 2013

(87) PCT Pub. No.: WO2011/150035

PCT Pub. Date: Dec. 1, 2011

(65) Prior Publication Data

US 2013/0205698 A1 Aug. 15, 2013

Related U.S. Application Data

(60) Provisional application No. 61/349,353, filed on May 28, 2010.

(51) Int. Cl.
*E04B 2/30* (2006.01)

(52) U.S. Cl.
USPC ..... 52/483.1; 52/302.1; 52/506.06; 52/513

(58) Field of Classification Search
USPC ..... 52/302.1, 302.3, 782.1, 483.1, 489.2, 52/506.06, 511, 513, 489.1, 235
See application file for complete search history.

(56) References Cited

U.S. PATENT DOCUMENTS

| | | | | |
|---|---|---|---|---|
| 3,412,515 | A | 11/1968 | Finon | |
| 4,070,835 | A | 1/1978 | Reverend et al. | |
| 4,840,004 | A * | 6/1989 | Ting | 52/235 |
| 5,060,443 | A | 10/1991 | Pacione | |
| 5,144,786 | A | 9/1992 | Pacione | |
| 5,197,255 | A | 3/1993 | Fricker | |
| 5,259,163 | A | 11/1993 | Pacione | |
| 5,279,091 | A | 1/1994 | Williams et al. | |
| 5,280,689 | A | 1/1994 | Mill | |
| 5,329,738 | A | 7/1994 | Ovaert et al. | |
| 5,398,473 | A | 3/1995 | Chan | |
| 5,435,111 | A | 7/1995 | Cox et al. | |
| 5,505,029 | A | 4/1996 | Lind | |
| 5,544,461 | A * | 8/1996 | Sommerstein | 52/235 |

(Continued)

FOREIGN PATENT DOCUMENTS

| | | |
|---|---|---|
| AU | 692134 B3 | 5/1998 |
| CH | 659679 A5 | 2/1987 |

(Continued)

OTHER PUBLICATIONS

International Search Report and Written Opinion dated Jul. 2, 2012 pertaining to PCT/US2011/037871.

*Primary Examiner* — Brian Glessner
*Assistant Examiner* — Brian D Mattei
(74) *Attorney, Agent, or Firm* — Dinsmore & Shohl LLP

(57) ABSTRACT

Visible and concealed cladding systems used for attaching laminate panels to building structures are provided. The visible cladding systems comprise tracks and sliding clips to slide the laminate panel into the desired location on the building wall. The concealed cladding systems comprise hanger elements to attach a laminate panel to the building wall.

22 Claims, 7 Drawing Sheets

(56) References Cited

U.S. PATENT DOCUMENTS

| | | | | |
|---|---|---|---|---|
| 5,579,624 | A | 12/1996 | Aeberhard | |
| 5,598,671 | A * | 2/1997 | Ting | 52/235 |
| 5,673,529 | A | 10/1997 | Treister | |
| 5,797,233 | A | 8/1998 | Hascall | |
| 5,953,876 | A | 9/1999 | Agar | |
| 5,956,910 | A * | 9/1999 | Sommerstein et al. | 52/235 |
| 6,006,485 | A | 12/1999 | Hobbs et al. | |
| 6,122,867 | A | 9/2000 | Leconte | |
| 6,122,876 | A | 9/2000 | Bado et al. | |
| 6,170,214 | B1 | 1/2001 | Treister et al. | |
| 6,178,713 | B1 | 1/2001 | Delie et al. | |
| 6,202,377 | B1 | 3/2001 | Krieger | |
| 6,216,409 | B1 | 4/2001 | Roy et al. | |
| 6,226,947 | B1 | 5/2001 | Bado et al. | |
| 6,260,324 | B1 | 7/2001 | Miedema et al. | |
| 6,374,561 | B1 | 4/2002 | Ishiko | |
| 6,418,683 | B1 | 7/2002 | Martensson et al. | |
| 6,421,970 | B1 | 7/2002 | Martensson et al. | |
| 6,481,179 | B2 | 11/2002 | Zen | |
| 6,588,166 | B2 | 7/2003 | Martensson et al. | |
| 6,606,834 | B2 | 8/2003 | Martensson et al. | |
| 6,647,691 | B2 | 11/2003 | Becker et al. | |
| 6,951,087 | B2 | 10/2005 | Weurman | |
| 7,028,446 | B2 | 4/2006 | Winchester | |
| 7,043,884 | B2 | 5/2006 | Moreno | |
| 7,134,247 | B2 * | 11/2006 | Ting | 52/235 |
| 7,191,570 | B1 | 3/2007 | Eaton | |
| 7,313,891 | B2 | 1/2008 | Showers | |
| 7,596,911 | B2 | 10/2009 | Turco | |
| 7,748,182 | B2 | 7/2010 | McGee et al. | |
| 7,793,482 | B2 | 9/2010 | Becker et al. | |
| 2002/0023402 | A1 | 2/2002 | Winchester | |
| 2002/0189192 | A1 | 12/2002 | Becker et al. | |
| 2005/0066613 | A1 | 3/2005 | Bourque | |
| 2006/0156638 | A1 | 7/2006 | Edkins | |
| 2006/0277841 | A1 | 12/2006 | Majusiak | |
| 2007/0033891 | A1 | 2/2007 | Imbabi | |
| 2008/0104918 | A1 | 5/2008 | Gleeson et al. | |
| 2008/0134594 | A1 * | 6/2008 | Ness | 52/200 |
| 2008/0172969 | A1 | 7/2008 | Schnepf et al. | |
| 2008/0216430 | A1 | 9/2008 | Gleeson et al. | |
| 2009/0019795 | A1 | 1/2009 | Szacsvay et al. | |
| 2009/0025335 | A1 | 1/2009 | Flynn et al. | |
| 2009/0241451 | A1 * | 10/2009 | Griffiths | 52/309.4 |
| 2009/0272060 | A1 | 11/2009 | Lucchesi | |
| 2009/0313932 | A1 | 12/2009 | Montgomery | |
| 2010/0031597 | A1 | 2/2010 | Baek | |
| 2010/0088992 | A1 | 4/2010 | Hatzinikolas | |
| 2010/0218432 | A1 | 9/2010 | Vardaro et al. | |
| 2010/0229484 | A1 | 9/2010 | Carolan et al. | |
| 2010/0300016 | A1 * | 12/2010 | Eickhof | 52/136 |

FOREIGN PATENT DOCUMENTS

| | | | |
|---|---|---|---|
| DE | 29906465 | U1 | 7/1999 |
| DE | 102005019977 | A1 | 11/2006 |
| EP | 0067970 | A1 | 12/1982 |
| EP | 0286052 | A2 | 10/1988 |
| EP | 0290426 | A2 | 11/1988 |
| EP | 0304338 | A1 | 2/1989 |
| EP | 0311738 | A1 | 4/1989 |
| EP | 0337066 | A1 | 10/1989 |
| EP | 0345661 | A1 | 12/1989 |
| EP | 0360001 | A1 | 3/1990 |
| EP | 0391737 | A1 | 10/1990 |
| EP | 0411426 | A2 | 2/1991 |
| EP | 0415201 | A2 | 3/1991 |
| EP | 0430667 | A2 | 6/1991 |
| EP | 0466992 | A1 | 1/1992 |
| EP | 0526261 | A1 | 2/1993 |
| EP | 0581664 | A1 | 2/1994 |
| EP | 0585635 | A1 | 3/1994 |
| EP | 0608443 | A1 | 8/1994 |
| EP | 0632169 | A2 | 1/1995 |
| EP | 0651113 | A1 | 5/1995 |
| EP | 0658666 | A1 | 6/1995 |
| EP | 0683287 | A1 | 11/1995 |
| EP | 0685614 | A1 | 12/1995 |
| EP | 0708213 | A1 | 4/1996 |
| EP | 0864703 | A2 | 9/1998 |
| EP | 0882853 | A1 | 12/1998 |
| EP | 0931942 | A1 | 7/1999 |
| EP | 0957216 | A1 | 11/1999 |
| EP | 0963496 | A1 | 12/1999 |
| EP | 1031674 | A1 | 8/2000 |
| EP | 1046491 | A2 | 10/2000 |
| EP | 1067251 | A2 | 1/2001 |
| EP | 1122363 | A1 | 8/2001 |
| EP | 1172500 | A1 | 1/2002 |
| EP | 1273730 | A2 | 1/2003 |
| EP | 1333131 | A1 | 8/2003 |
| EP | 1338719 | A1 | 8/2003 |
| EP | 1422357 | A2 | 5/2004 |
| EP | 1441085 | A1 | 7/2004 |
| EP | 1443160 | A1 | 8/2004 |
| EP | 1496171 | A2 | 1/2005 |
| EP | 1529141 | A1 | 5/2005 |
| EP | 1533442 | A1 | 5/2005 |
| EP | 1697601 | A1 | 9/2006 |
| EP | 1712701 | A1 | 10/2006 |
| EP | 1764455 | A2 | 3/2007 |
| EP | 1764456 | A2 | 3/2007 |
| EP | 1826335 | A1 | 8/2007 |
| EP | 1882791 | A2 | 1/2008 |
| EP | 2128355 | A1 | 2/2009 |
| EP | 2039846 | A1 | 3/2009 |
| EP | 2110491 | A1 | 10/2009 |
| ES | 2303404 | A1 | 8/2008 |
| JP | 2002047750 | A | 2/2002 |
| NL | 1005434 | C2 | 9/1998 |
| WO | 91/05923 | A1 | 5/1991 |
| WO | 93/05251 | A1 | 3/1993 |
| WO | 96/06246 | A1 | 2/1996 |
| WO | 98/10151 | A1 | 3/1998 |
| WO | 99/54569 | A1 | 10/1999 |
| WO | 99/64692 | A1 | 12/1999 |
| WO | 00/23672 | A1 | 4/2000 |
| WO | 00/29688 | A1 | 5/2000 |
| WO | 02/02887 | A1 | 1/2002 |
| WO | 02/27109 | A1 | 4/2002 |
| WO | 02/084038 | A1 | 10/2002 |
| WO | 02/095162 | A1 | 11/2002 |
| WO | 03/002819 | A1 | 1/2003 |
| WO | 03/012223 | A1 | 2/2003 |
| WO | 2004/031503 | A1 | 4/2004 |
| WO | 2004/035959 | A1 | 4/2004 |
| WO | 2004/070133 | A1 | 8/2004 |
| WO | 2004/074594 | A1 | 9/2004 |
| WO | 2004/103700 | A1 | 12/2004 |
| WO | 2005/003478 | A1 | 1/2005 |
| WO | 2005/118977 | A1 | 12/2005 |
| WO | 2006/039762 | A1 | 4/2006 |
| WO | 2006/064268 | A1 | 6/2006 |
| WO | 2006/064489 | A1 | 6/2006 |
| WO | 2007/091233 | A1 | 8/2007 |
| WO | 2007/098761 | A1 | 9/2007 |
| WO | 2008/014551 | A1 | 2/2008 |
| WO | 2008/099372 | A1 | 8/2008 |
| WO | 2008/101320 | A1 | 8/2008 |
| WO | 2008/101325 | A1 | 8/2008 |
| WO | 2008/106735 | A1 | 9/2008 |
| WO | 2008/003975 | A1 | 10/2008 |
| WO | 2008/124944 | A1 | 10/2008 |
| WO | 2008/129523 | A1 | 10/2008 |
| WO | 2009/037157 | A1 | 3/2009 |
| WO | 2009/059392 | A1 | 5/2009 |
| WO | 2009074346 | A2 | 6/2009 |
| WO | 2009/095936 | A1 | 8/2009 |
| WO | 2009/120158 | A1 | 10/2009 |

* cited by examiner

CLADDING SYSTEM FOR BUILDING LAMINATES

This application claims priority to U.S. Provisional Application Ser. No. 61/349,353 filed May 28, 2010, which is incorporated by reference herein in its entirety.

The present invention relates generally to laminate panels (also called facade cladding panels) to be applied to the facade of buildings, and specifically relates to cladding systems and methods for affixing the laminate panels to building facades more efficiently and with less cost.

According to one embodiment, a visible cladding system for attaching laminate panels onto a building wall is provided. The visible cladding system comprises at least one laminate panel support beam to be mounted onto a building wall, wherein the laminate panel support beam comprises at least one track. The visible cladding system also comprises at least one secondary support beam mounted to the at least one laminate panel support beam, at least one sliding clip slidingly coupled to at least one track, and at least one laminate panel coupled to at least one sliding clip and thereby slidable along the track, wherein the laminate panel is configured to be fastened to the secondary support beam.

According to yet another embodiment, a concealed cladding system configured for attaching laminate panels onto a building wall is provided. The system comprises at least two wall brackets horizontally spaced apart, wherein each wall bracket comprises an upper attachment component and a lower attachment component. The system also comprises at least one intermediate connector coupled to the wall brackets, wherein the intermediate connector comprises an upper coupling mechanism, a lower coupling mechanism, and a hanger member. The upper coupling mechanism of the intermediate connector is coupled with the upper attachment component of the wall brackets, and the lower attachment component of the intermediate connector is coupled with the upper attachment component of the wall bracket. The concealed cladding system also comprises at least one hanger clip having a laminate panel hanger member coupled with the hanger member of the intermediate connector; and a laminate panel fastened to at least one of the hanger clips.

The features and advantages of the present invention will become apparent from the following description and the accompanying drawings.

The following detailed description of the embodiments of the present invention can be best understood when read in conjunction with the following drawings, where like structure is indicated with like reference numerals.

Figure 1:
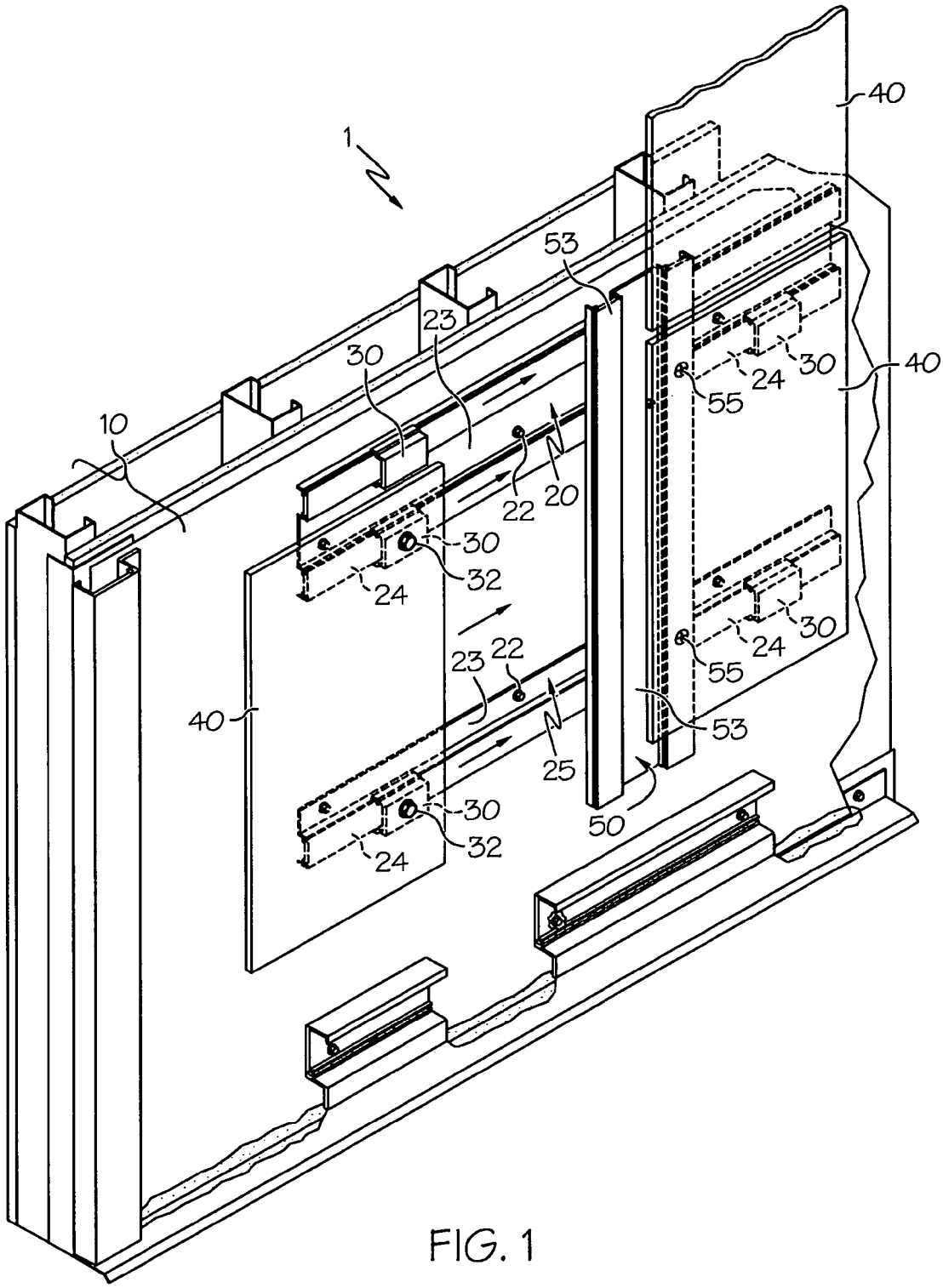
FIG. 1 is a perspective view of a visible cladding attachment system according to one or more embodiments of the present invention.
Figure 2A:
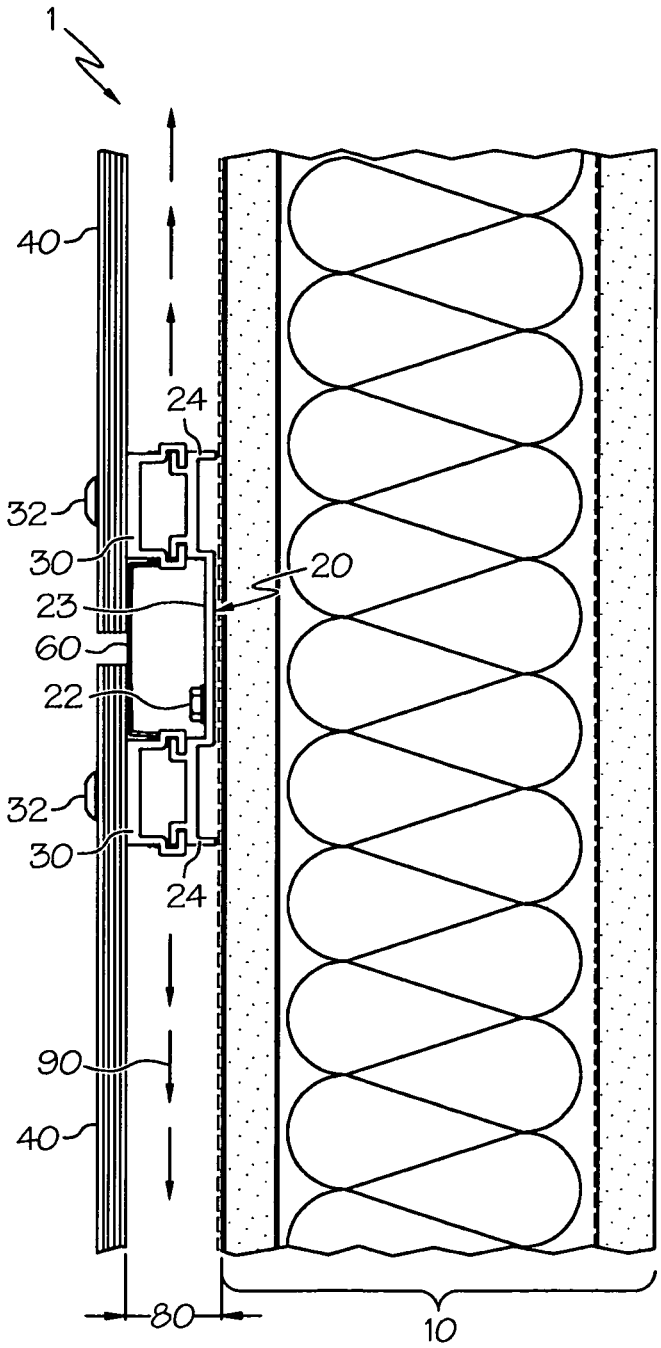
FIG. 2A is a horizontal cross-sectional view of a visible cladding attachment system according to one or more embodiments of the present invention.
Figure 2B:
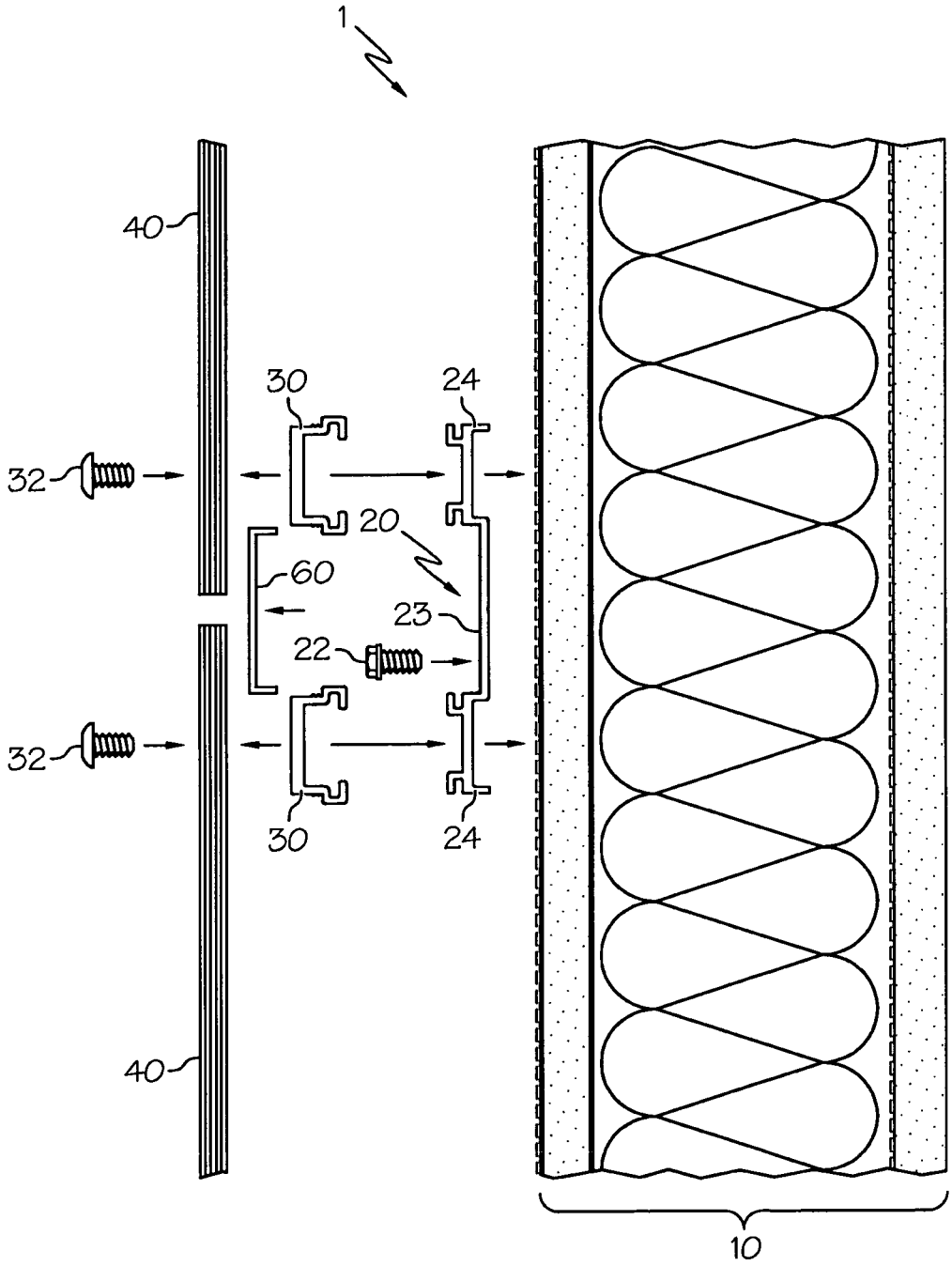
FIG. 2B is an exploded cross-sectional view of a visible cladding attachment system according to one or more embodiments of the present invention.

Referring to FIGS. 1, 2A and 2B, a visible system 1 for fastening laminate panels 40 onto a building wall 10 is provided. As stated above, this system 1 is considered a visible cladding attachment system, because the cladding fastener component(s) 32 are not hidden behind the laminate panels 40. As used herein, the building wall 10 may comprise many suitable structures familiar to one of ordinary skill in the art, such as a stud wall, exterior sheathing, a jam flashing membrane, a water resistive barrier, insulation, or any other building or foundation structure.

Referring again to FIGS. 1, 2A and 2B, the system 1 comprises at least one laminate panel support beam 20, 25 mounted onto the building wall 10, wherein the laminate panel support beam 20, 25 comprises at least one track 24. In the embodiment of FIGS. 1, 2A and 2B, the laminate panel support beam 20 may be mounted directly onto the building wall 10 or may be coupled to an additional mounting structure (not shown) mounted on the building wall 10. Also, while the present discussion centers on a laminate panel support beam 20, 25 having a horizontal configuration, is it contemplated that the laminate panel support beam 20, 25 could be positioned vertically or diagonally if required by the structure and/or contours of the building wall 10.

Referring again to the embodiment shown in FIGS. 1, 2A-B, the laminate panel support beam 20 may comprise two spaced parallel tracks 24. In this embodiment, the laminate panel support beam 20 may define a W-shape configuration wherein the tracks 24 constitute raised portions of the laminate panel support beam 20, and the portion between the tracks 24 is a non-raised beam 23 that abuts a building wall 10. As shown, the laminate panel support beam 20 of FIGS. 1, 2A-B may be mounted onto the building wall 10 via one or more fasteners 22. Many fasteners are contemplated herein, for example, screws, bolts, nails, or combinations thereof. The fasteners 22 may comprise any suitable rigid material, for example, metals or metal alloys such as stainless steel, aluminum, or combinations thereof.

In an alternative embodiment as shown in FIG. 1, the laminate panel support beam 25 may comprise one track 24. In this embodiment, the laminate panel support beam 25 may define a J-shape configuration wherein the track 24 is a raised portion of the laminate panel support beam 25. In the J-shape configuration, the nonraised portion adjacent the track 24 contacts the building wall 10, and is fastened to the building wall 10 with a fastener 22. As shown in FIG. 1, the laminate panel support beam 25 of FIG. 1 may be mounted onto the building wall 10 via one or more fasteners 22. Further as shown, the one track laminate panel support beam 25 may be mounted on the building wall 10 proximate a two track laminate panel support beam 20. While the depicted laminate panel support beams 20 and 25 are depicted as having one or two tracks and a J-shaped or W-shaped geometry, other structures and configurations are contemplated herein.

Referring to FIG. 1, the system 1 may also comprise at least one secondary support beam 50 oriented generally perpendicular to the laminate panel support beam 20, 25 and mounted to at least one laminate panel support beam 20, 25. While the present discussion centers on secondary support beams 50 having a vertical configuration, is it contemplated that the secondary support beam 50 could be positioned horizontally or diagonally if required by the structure and/or contours of the building wall 10. As shown in the embodiment of FIG. 1, the secondary support beam 50 may be mounted to two laminate panel support beams 20, 25. It is also alternatively contemplated that the secondary support beam 50 may be coupled to less than two or more than two laminate panel support beams 20, 25. Moreover, it is also contemplated that the secondary support beam 50 may also define various structural shapes and structural profiles. As shown in the embodiment of FIG. 1, the secondary support beam 50 may comprise a pair of parallel raised beams 52 connected by a nonraised beam 53 disposed therebetween. As an alternative to this raised/nonraised profile, other embodiments may include a flat profile.

Referring again to FIGS. 1, 2A and 2B, the system 1 may also comprise at least one sliding clip 30 that is configured for attaching laminate panels 40 to the laminate panel support beams 20, 25. The sliding clips 30 may be slidingly coupled to track 24, and are also attached to one or more laminate panels 40, which are moveable with the sliding clips 30. As shown in FIGS. 1, 2A and 2B, the system 1 may comprise two sliding clips 30 slidingly coupled to the two spaced tracks 24 of the two track laminate panel support beam 20, as well as a sliding clip 30 slidingly coupled to the one track laminate panel support beam 25. While the FIGS depict only one sliding clip 30 per track, it is contemplated to have multiple sliding clips 30 on each track 24.

Referring yet again to FIGS. 1, 2A, and 2B, the two track laminate panel support beam 20 may comprise two laminate panels 40 coupled thereto. In another embodiment as shown, the laminate panel 40 may be coupled at one end to a sliding clip 30 attached to a track on the two track lateral support beam 20, and coupled at an opposite end to a sliding clip 30 on the one track laminate panel support beam 25. The laminate panel 40 may be coupled to the sliding clip 30 via a fastening component 32. The fastening component 32 is a bolt, a screw, or any other suitable fastener. The fastening component 32 may comprise a rigid material, for example, aluminum, stainless steel, or combinations thereof.

When mounting the laminate panel 40 onto the laminate panel support beam 20, various assembly sequences are contemplated. For example, the sliding clip(s) 30 may first be moved along the track(s) 24 to the desired position on the laminate panel support beam 20, 25, at which point, the laminate panel 40 is then attached to the sliding clip 30. Alternatively as shown in FIG. 1, the sliding clip(s) 30 is first attached to the laminate panel 40, then the sliding clip(s) 30 and attached laminate panel 40 may be slidingly moved along the track(s) 24 to the desired position on the laminate panel support beams 20, 25. In essence, the laminate panel 40 may be coupled to one or more of the sliding clips 30 before or after the sliding clips 30 are coupled to the tracks 24 of the laminate panel support beam 20. After the laminate panel 40 is positioned at the desired position on the building wall 10, the laminate panel 40 may then be secured to the secondary support beam 50 by means of a fastener 55. Like the other fasteners described above, the fastening component 55 may comprise a bolt, screw, or another suitable fastening component known to one of ordinary skill in the art. Without being bound by theory, the sliding functionality of the track 24 and clip 30 assembly enables the laminate panel 40 to be quickly attached to the facade of a building, or quickly removed, thereby reducing labor costs.

Various materials and compositions are contemplated for the visible system 1. In one embodiment, the laminate panel 40 may be a phenolic resin based material. A suitable commercial embodiment for the laminate panel 40 is the VIVIX™ laminate produced by Formica®. The laminate panel support beam 20, the sliding clip 30, and the secondary support beam 50 may all comprise rigid support material, for example, a metal, a metal alloy, or combinations thereof. In exemplary embodiments, these rigid support materials may be selected from the group consisting of aluminum, stainless steel, or combinations thereof.

In a further embodiment as shown in FIGS. 2A-B, the system 1 may also comprise a joint closure 60 disposed between sliding clips 30 on adjacent yet separated laminate panels 40. The joint closure 60 is positioned to block the opening between the adjacent yet separated panels 40. The joint closure 60, as shown in FIG. 2A, defines a C-shape adapted for the joint closure 60 to fit snugly between a pair of sliding clips 30; however other geometries are contemplated herein. While many materials are contemplated for the joint closure 60, the joint closure 60 may comprise a rigid metal material such as aluminum or stainless steel.

Figure 3:
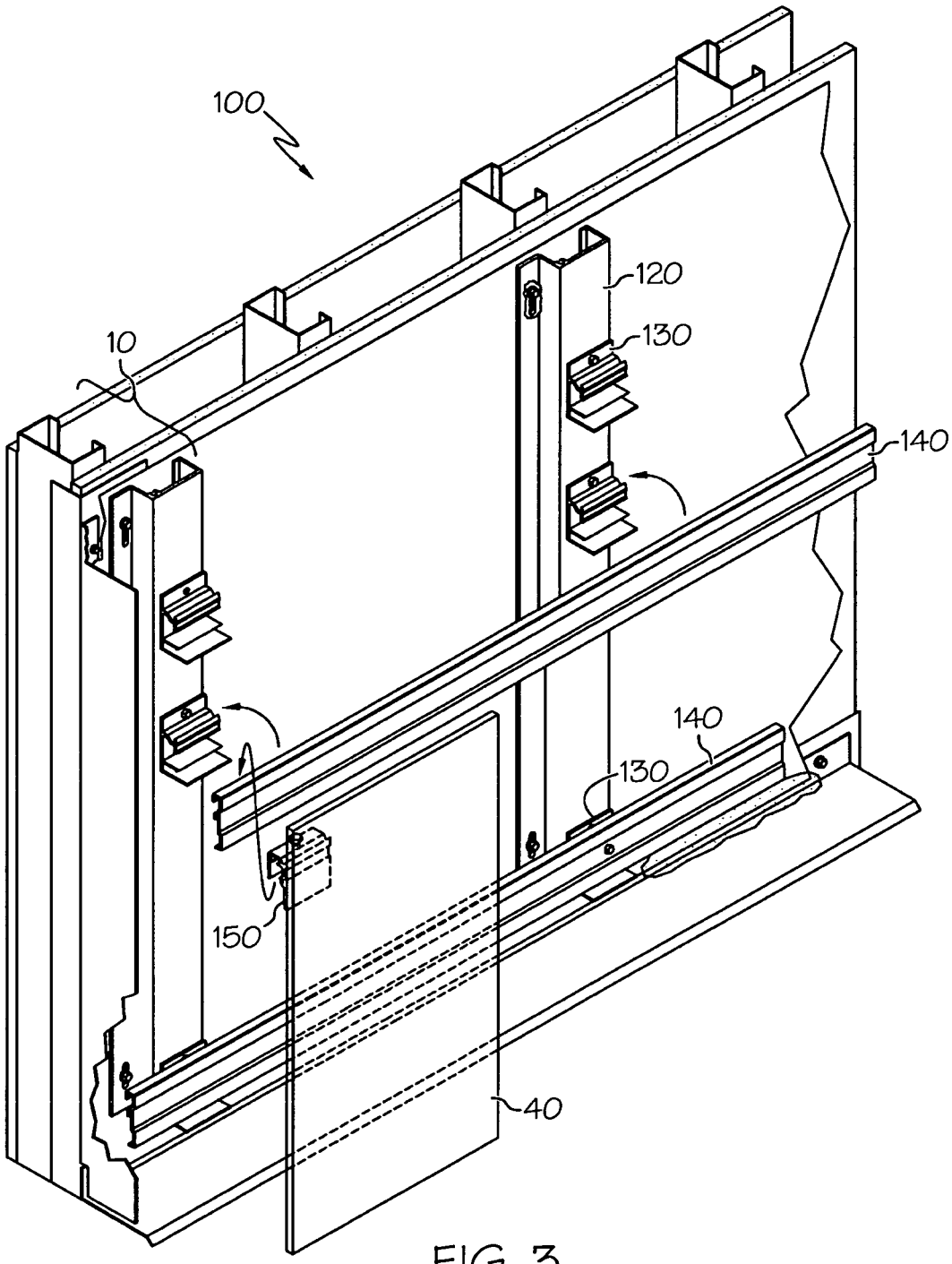
FIG. 3 is a perspective view of a concealed cladding attachment system according to one or more embodiments of the present invention.
Figure 4A:
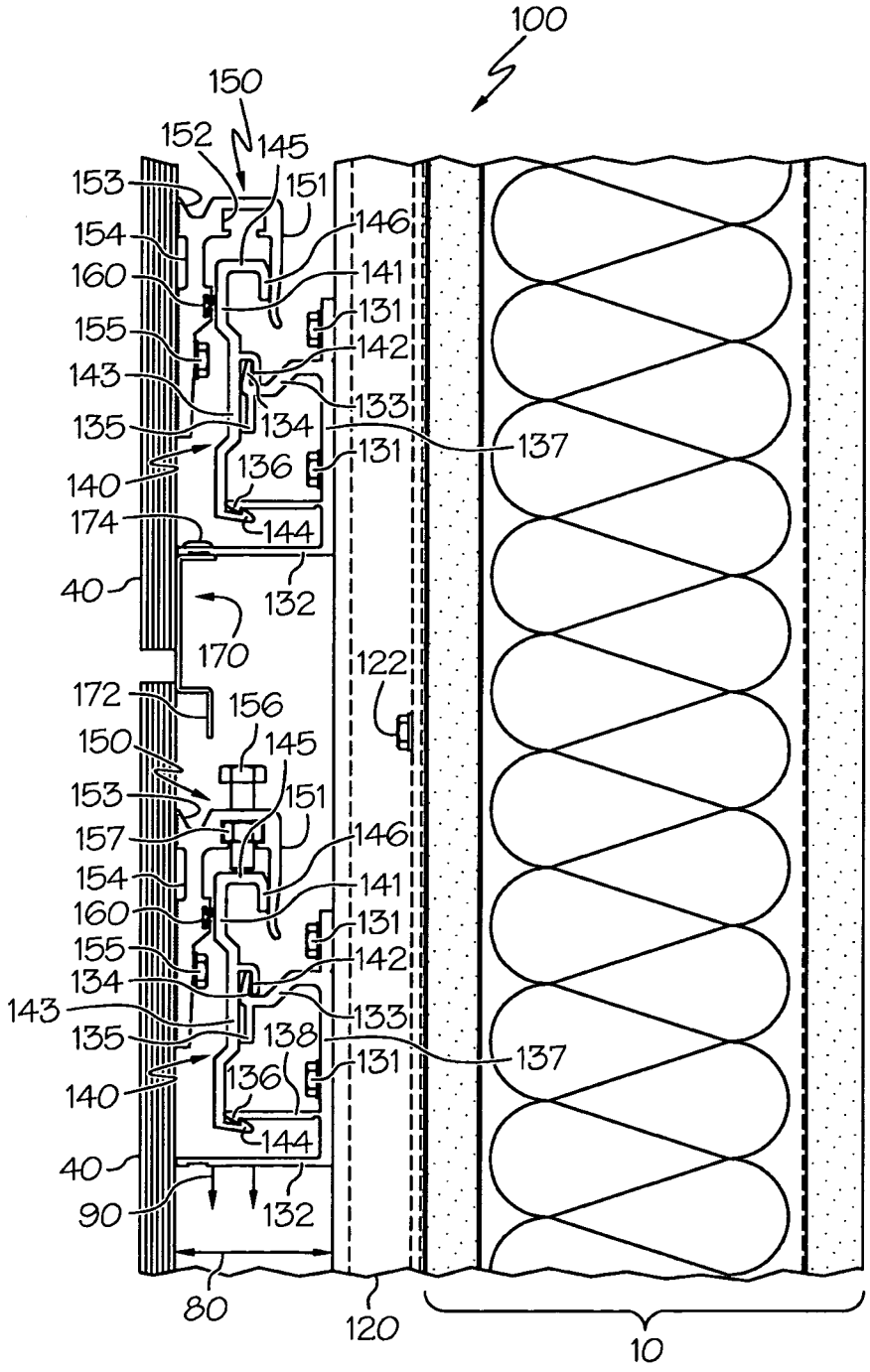
FIG. 4A is a horizontal cross-sectional view of a concealed cladding attachment system according to one or more embodiments of the present invention.
Figure 4B:
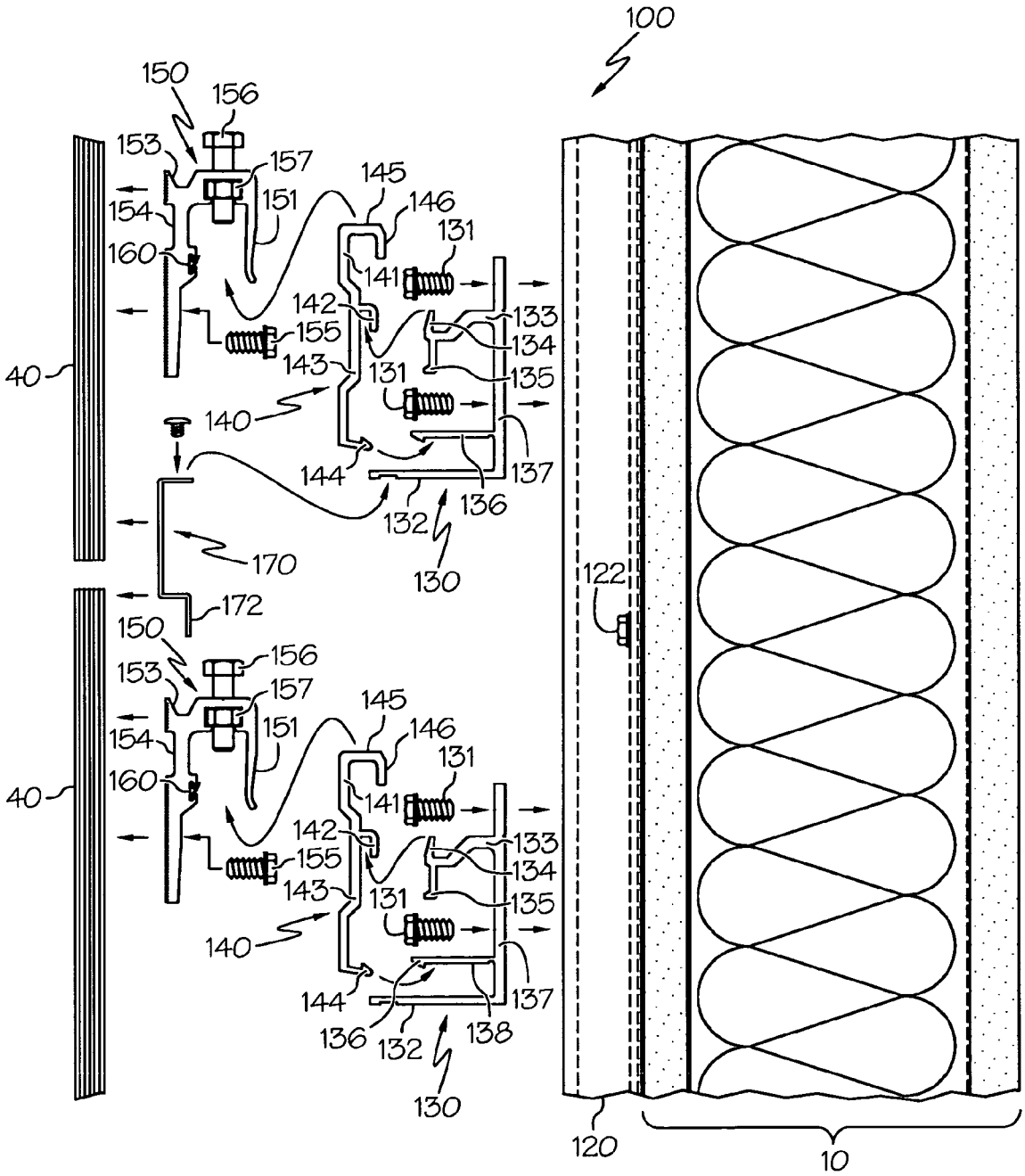
FIG. 4B is an exploded cross-sectional view of a concealed cladding attachment system according to one or more embodiments of the present invention.
Figure 4C:
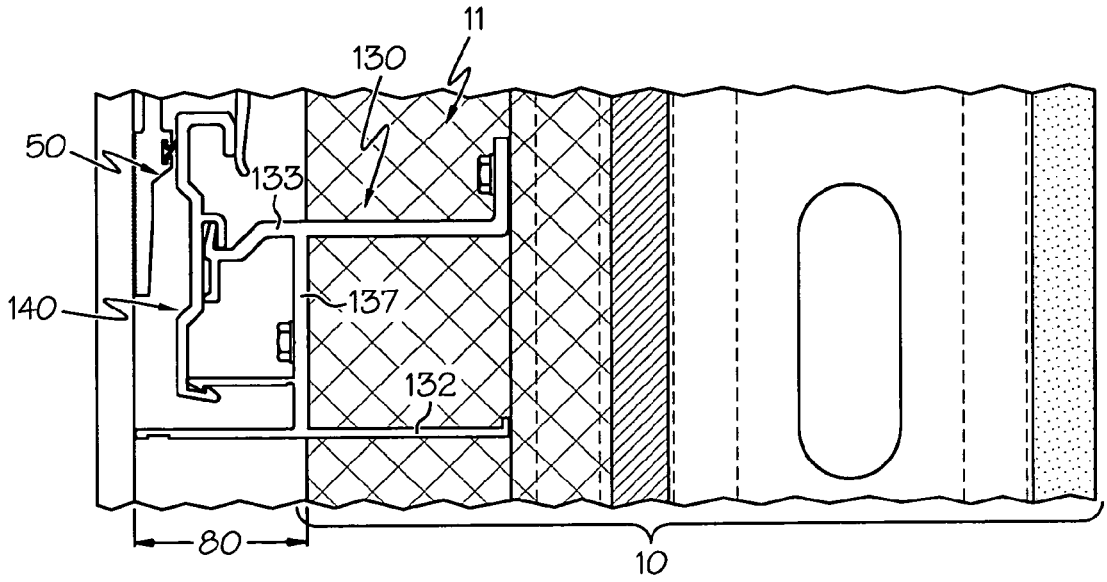
FIG. 4C is a horizontal cross-sectional view of another concealed cladding attachment system according to one or more embodiments of the present invention.
Figure 4D:
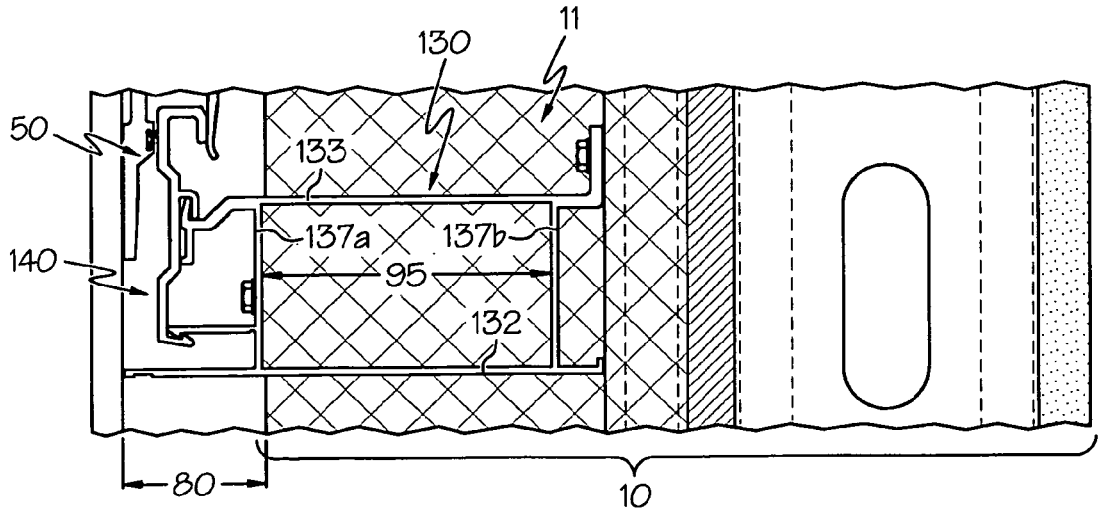
FIG. 4D is a horizontal cross-sectional view of yet another concealed cladding attachment system according to one or more embodiments of the present invention.

Referring to FIGS. 3 and 4A-4D, a concealed cladding attachment system 100 for fastening laminate panels 40 onto a building wall 10 is provided. In contrast to the visible system 1, this system 100 is considered a concealed cladding attachment system, because the support attachments are disposed behind the laminate panels 40. Referring to FIG. 3, the system 100 may comprise at least two wall brackets 130 horizontally spaced apart and attached to vertical beams 120 supported by the building wall 10 as shown in FIGS. 3, 4A, and 4B, or mounted directly to the building wall 10 as shown in FIGS. 4C and 4D. As shown in FIGS. 4A and 4B, the vertical beams 120 may be mounted onto the building wall 10 via a fastener 122 (e.g., a bolt, a screw, etc).

Various geometries and structures are contemplated for the wall bracket 130. As shown in FIGS. 4A-B, wall bracket 30 may define an L-shaped cross-sectional profile comprising a vertical portion 137 attached to vertical beams 120 and a horizontal portion 132 extending perpendicularly from the bottom of the vertical portion 137. The vertical portion 137 is attached to the vertical beams 120 via fasteners 131, such as screws or bolts. In one embodiment, the horizontal portion 132 of the wall bracket 130 is configured to extend the distance of a cavity 80 between the laminate panel 40 and the vertical beams 120. As shown, the cavity 80 enables water drainage and air flow 90 in the concealed cladding attachment system 100, or the visible cladding attachment system 1. As an alternative to the L-configuration of FIGS. 4A and 4B, referring to FIG. 4C, the vertical portion 137 is attached to an outer surface of a building wall 10; however, the wall bracket 130 comprises a horizontal portion 132 and/or a horizontal arm 133 that extends behind the vertical portion 137 and at least partially through a building wall 10 or insulation 11.

Moreover, as shown in FIG. 4D, the wall bracket 130 may comprise a pair of spaced parallel vertical portions 137*a*, 137*b*. As shown in the embodiment of FIG. 4D, one of the vertical portions 137*b* may be disposed inside the insulation 11 of the building wall 10, whereas the other vertical portion 137*a* may contact a surface of the building wall 10. In this embodiment, the horizontal portion 132 of the wall bracket is parallel to the horizontal arm 133 of the upper attachment component 134. As shown, the horizontal portion 132 and the horizontal arm 133 extend perpendicular between the vertical portions 137*a* and 137*b*. Moreover as shown in FIG. 4D, the horizontal portion 132 and the horizontal arm 133 also extend beyond the distance 95 between the parallel vertical portions 137*a*, 137*b*. For example, the horizontal portion 132 and the horizontal arm 133 may extend the length of the insulation 11.

Further as shown in FIGS. 4A-B, the wall bracket 130 may comprise an upper attachment component 134 and a lower attachment component 136 for coupling with the intermediate connector 140, as described in detail below. The lower attachment component 136 is attached to a horizontal arm 138 extending from the vertical portion 137 at a position above and parallel to the horizontal portion 132 of the wall bracket 130. In one embodiment, the lower attachment component 136 may be a protrusion configured to interlock with a corresponding protrusion of the lower coupling mechanism 144 of the intermediate connector 140. The upper attachment component 134 may comprise a hook insertable into a receptacle, 142, i.e., the upper coupling mechanism 142 as described in further detail below. As shown in FIGS. 4A and 4B, the hook of the upper attachment component 134 is attached to another horizontal arm 133 extending from the vertical portion 137 of the wall bracket 130. Various other suitable structural components are contemplated for the upper attachment component 134 and the lower attachment component 136.

Referring again to FIGS. 3, and 4A-4D, the system 100 also comprises at least one intermediate connector 140 coupled to the wall bracket 130. The intermediate connector 140 comprises an upper coupling mechanism 142 configured to be coupled with the upper attachment component 134 of the wall bracket 130. In one embodiment, the intermediate connector 140 may matingly couple with the upper attachment component 134 of the wall bracket 130. For example as shown in FIGS. 4A-4D, the upper coupling mechanism 142 may comprise a receptacle 142 that receives the hook 134 of the wall bracket 130.

As shown in FIGS. 3 and 4B, the intermediate connector 140 also comprises a lower coupling mechanism 144 configured to couple with the lower attachment component 136 of the wall bracket 130. In one embodiment, the lower coupling mechanism may interlockingly couple with the lower attachment component 136. As shown, the lower attachment component 136 of the intermediate connector 140 is a protrusion, which causes the lower attachment component 136 of the wall bracket 130 to deflect inwardly to facilitate the interlocking coupling arrangement. When attaching the intermediate connector 140 to the wall bracket 130, the intermediate connector 140 is rotated such that the receptacle 142 attaches to the hook 134, then the intermediate connector 140 is further rotated such that the lower coupling mechanism 144 (e.g., the protrusion 144) deflects the lower attachment component 136 (e.g., the protrusion 136) inwardly.

Having multiple connections between the wall bracket 130 and the intermediate connector 140 as described above helps ensure the wall bracket 130 is secured to the intermediate connector 140. That being said, the system 100 may also comprise a bumper 135 or extension coupled to the horizontal arm 133 of the wall bracket 130, which is configured to engage an inward section 143 of the intermediate connector 140 to further secure the intermediate connector 140 on the wall bracket 130.

Further as shown in FIGS. 3, 4A, and 4B, the intermediate connector 140 also comprises an intermediate hanger member 146 used for coupling with the laminate panel hanger member 151 of the hanger clip 150. Referring to FIGS. 3, and 4A-B, the hanger clips 150, which join the laminate panel 40 to the intermediate connector 140, utilize their respective laminate panel hanger member 151 to matingly couple with the intermediate hanger member 146 of the intermediate connector 140. Specifically as shown, the intermediate hanger member 146 is nested within the laminate panel hanger member 151.

When attaching the laminate panel 40 in the system 100 of the present invention, various assembly sequences are contemplated. Specifically, the hanger clips 150 may be coupled to the laminate panels 40 prior to the attachment of the hanger clip(s) 150 to the intermediate connector(s) 140. In an alternative embodiment, it is contemplated that the hanger clip(s) 150 may be attached to the intermediate connector(s) 140 prior to the laminate panels 40 being attached to the hanger clips 150. The hanger clip 150 may be attached to the laminate panel 40 via any suitable fastener 155, such as a screw or bolt.

The hanger clip 150 comprises additional components which ensure that the hanger clip 150 is securely attached to the intermediate connector 140. As shown in FIGS. 4A-4B, the hanger clip 150 may comprise an adjustable bolt 156, which may be adjusted to engage the upper surface 145 of the intermediate connector 140 to stabilize the hanger clip 150 on the intermediate connector 140. In a specific embodiment, the hanger clip 150 is manufactured and packaged with the adjustable bolt 156 and nut 157 attached, wherein the nut 157 is disposed in a slot 152 of the hanger clip 150. Packaging the adjustable bolt 156 and nut 157 with the hanger clip 150 eliminates the need for the consumer to purchase a separate fastener to secure the hanger clip 150 to the intermediate connector 140.

In further embodiments as shown in FIGS. 4A-B, the hanger clip 150 may also comprise a flexible cushioning component 160, which engages a surface 141 of the intermediate connector 140 to stabilize the hanger clip 150 on the intermediate connector 140. As shown, the flexible cushioning component 160, which may be embedded in the hanger clip 150, has a flexible tip, which deflects upon engaging surface 141 of the intermediate connector 140. By engaging the intermediate connector 140, the flexible cushioning component 160 helps prevent the intermediate connector 140 or hanger clip 150 from moving relative to each other, thereby further securing the hanger clip 150 on the intermediate connector 140. The flexible cushioning component 160 may comprise any suitable flexible material, for example, a flexible polymeric nondegradable material such as polyurethane, Santoprene™, other thermoplastic elastomers, or combinations thereof In further embodiments as shown in FIGS. 4A-B, the hanger clip 150 may also comprises recessed reservoir portions 153, 154 operable to collect condensed water. The recessed reservoir portions 153, 154 may be sloped to facilitate the removal of condensate present on the recessed reservoir portions 153, 154 of the hanging clip 150. Similar to the visible cladding system 1, the concealed cladding attachment system 100 may also comprise a joint closure 170 coupled to the wall bracket 130 via fastener 174. As shown in FIGS. 4A-B, the joint closure 170 is configured to block the opening between adjacent yet separated laminate panels 40. Similar to the recessed reservoir portions 153, 154 of the hanger clip 150, the joint closure 60 comprises a lower lip 172 operable to collect and remove water.

Moreover, it is contemplated to use various additional structural components for the cladding systems depending on the needs of the builder. For example, pieces with different shapes and curvatures may be specifically developed for the contours or corners of the building wall 10.

It is further noted that terms like "preferably," "generally", "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is additionally noted that the term "substantially"

is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

The invention claimed is:

1. A concealed cladding attachment system configured for attaching laminate panels onto a building wall comprising:

at least two wall brackets horizontally spaced apart, wherein each wall bracket comprises an upper attachment component and a lower attachment component;

at least one intermediate connector coupled to the wall brackets and comprising an upper coupling mechanism, a lower coupling mechanism, and a hanger member, wherein the upper coupling mechanism of the intermediate connector is coupled with the upper attachment component of the wall brackets, and the lower coupling mechanism of the intermediate connector is coupled with the lower coupling mechanism attachment component of the wall bracket;

at least one hanger clip having a laminate panel hanger member coupled with the hanger member of the intermediate connector; and a laminate panel fastened to at least one of the hanger clips, wherein the at least two wall brackets, the at least one intermediate connector, and the at least one hanger clip are disposed entirely behind the laminate panels.

2. The system of claim 1 wherein the wall brackets are attached to vertical beams coupled to the building wall.

3. The system of claim 1 wherein the wall brackets are directly coupled to the building wall.

4. The system of claim 1 wherein the hanger clip comprises a flexible cushioning component which engages a surface of the intermediate connector to stabilize the hanger clip on the intermediate connector.

5. The system of claim 1 wherein the hanger member of the intermediate connector is nested within the hanger clip during coupling.

6. The system of claim 1 wherein the wall bracket defines an L-shaped cross-section and comprises a vertical portion and a horizontal portion extending perpendicularly from the bottom of the vertical portion.

7. The system of claim 1 wherein the wall bracket comprises a pair of spaced parallel vertical portions.

8. The system of claim 7 wherein the wall bracket comprises a horizontal portion which is parallel to a horizontal arm of the upper attachment component, the horizontal portion and the horizontal arm extending perpendicular from and between the vertical portions, wherein the horizontal portion and the horizontal arm also extend beyond the distance between the parallel vertical portions.

9. The system of claim 1 wherein a horizontal portion of the wall bracket extends at least partially through the building wall or insulation behind the building wall.

10. The system of claim 1 wherein a horizontal arm of the upper attachment component extends at least partially through the building wall or insulation behind the building wall.

11. The system of claim 1 wherein the lower attachment component is a protrusion configured to interlock with a corresponding protrusion of the lower coupling mechanism of the intermediate connector.

12. The system of claim 1 wherein the upper attachment component is matingly coupled with the upper coupling mechanism of the intermediate connector.

13. The system of claim 1 wherein the upper attachment component comprises a bumper configured to engage an inward section of the intermediate connector to further secure the intermediate connector on the wall bracket.

14. The system of claim 1 wherein the hanger clip comprises an adjustable bolt operable to be adjusted to engage an upper surface of the intermediate connector to stabilize the hanger clip on the intermediate connector.

15. The system of claim 14 wherein the hanger clip comprises a nut attached to the adjustable bolt, wherein the nut is disposed in a slot of the hanger clip.

16. The system of claim 1 wherein the hanger clip comprises one or more recessed reservoir portions which are operable to collect condensed water.

17. A concealed cladding attachment system configured for attaching laminate panels onto a building wall comprising:

at least two wall brackets horizontally spaced apart, wherein each wall bracket comprises an upper attachment component and a lower attachment component, wherein a horizontal portion of the wall bracket extends the distance of a cavity between the laminate panel and vertical beams coupled to the building wall;

at least one intermediate connector coupled to the wall brackets and comprising an upper coupling mechanism, a lower coupling mechanism, and a hanger member, wherein the upper coupling mechanism of the intermediate connector is coupled with the upper attachment component of the wall brackets, and the lower coupling mechanism of the intermediate connector is coupled with the lower attachment component of the wall brackets;

at least one hanger clip having a laminate panel hanger member coupled with the hanger member of the intermediate connector; and a laminate panel fastened to at least one of the hanger clips.

18. The system of claim 17 wherein the hanger clip comprises a flexible cushioning component which engages a surface of the intermediate connector to stabilize the hanger clip on the intermediate connector.

19. The system of claim 17 wherein the hanger member of the intermediate connector is nested within the hanger clip during coupling.

20. The system of claim 17 wherein a horizontal portion of the wall bracket extends at least partially through the building wall or insulation behind the building wall.

21. The system of claim 17 wherein the upper attachment component comprises a bumper configured to engage an inward section of the intermediate connector to further secure the intermediate connector on the wall bracket.

22. The system of claim 17 wherein the hanger clip comprises one or more recessed reservoir portions which are operable to collect condensed water.

* * * * *